US007957226B2

(12) United States Patent
Chaignat et al.

(10) Patent No.: US 7,957,226 B2
(45) Date of Patent: Jun. 7, 2011

(54) CORRECTION DEVICE FOR TIMEPIECE DISPLAY MECHANISM AND WHEEL FITTED THERETO

(75) Inventors: Julien Chaignat, Le Landeron (CH); Marco Bettelini, Prêles (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 216 days.

(21) Appl. No.: 12/056,668

(22) Filed: Mar. 27, 2008

(65) Prior Publication Data

US 2008/0247277 A1 Oct. 9, 2008

(30) Foreign Application Priority Data

Apr. 4, 2007 (EP) ..... 07105669

(51) Int. Cl.
*G04B 19/20* (2006.01)

(52) U.S. Cl. ..... 368/35; 368/37; 368/185; 368/190; 74/434

(58) Field of Classification Search ..... 368/35, 368/37, 185, 190; 74/434, 435, 437, 439, 74/457

See application file for complete search history.

(56) References Cited

U.S. PATENT DOCUMENTS

| | | | | |
|---|---|---|---|---|
| 0,161,262 | A | 3/1875 | Moseley | |
| 951,197 | A | 3/1910 | O'Conner | |
| 1,036,954 | A | 8/1912 | Bell | |
| 1,142,051 | A * | 6/1915 | O'Connor | 74/437 |
| 1,538,494 | A * | 5/1925 | Tucker | 267/28 |
| 3,104,517 | A | 9/1963 | Wuthrich | |
| 3,360,922 | A | 1/1968 | Rogers | |
| 3,487,631 | A | 1/1970 | Morita | |
| 3,735,583 | A | 5/1973 | Bachmann | |
| 3,851,540 | A | 12/1974 | Tutiya | |
| 3,855,785 | A | 12/1974 | Ushikoshi | |
| 5,083,300 | A | 1/1992 | Schwartz | |

(Continued)

FOREIGN PATENT DOCUMENTS

| | | |
|---|---|---|
| CH | 347 139 | 7/1960 |

(Continued)

OTHER PUBLICATIONS

European Search Report issued in corresponding application No. EP 07 10 5669, completed Jan. 22, 2008.

(Continued)

*Primary Examiner* — Renee Luebke
*Assistant Examiner* — Jason Collins
(74) *Attorney, Agent, or Firm* — Griffin & Szipl, P.C.

(57) ABSTRACT

A correction device for a timepiece display mechanism, which includes a display member fitted with a toothing of pitch P, includes a pinion provided with a toothing of pitch p, mounted on a winding stem so as to occupy at least one display correcting position A, and a correction wheel mounted between the pinion and the display member. The correction wheel includes a first toothing defined by pitch P, a head diameter D, and a foot diameter d1, formed of teeth including a tip extending substantially angularly, and the tip is cut so as to form a second discontinuous toothing that is coplanar and concentric to the first toothing, defined by pitch p less than the pitch P of the first toothing, a head diameter D equal to the head diameter of the first toothing, and a foot diameter d2 greater than the foot diameter d1 of the first toothing.

20 Claims, 4 Drawing Sheets

U.S. PATENT DOCUMENTS

| | | | | |
|---|---|---|---|---|
| 5,303,213 | A | 4/1994 | Kaelin | |
| 5,666,854 | A * | 9/1997 | Buri et al. | 74/434 |
| 6,295,249 | B1 | 9/2001 | Takahashi et al. | |
| 6,802,645 | B2 * | 10/2004 | Ludwig | 368/127 |
| 7,563,020 | B2 | 7/2009 | Pittet | |
| 2006/0215498 | A1 | 9/2006 | Meier | |
| 2008/0245171 | A1 | 10/2008 | Chaignat et al. | |

FOREIGN PATENT DOCUMENTS

| | | | |
|---|---|---|---|
| CH | 493 874 | | 8/1970 |
| EP | 1 538 494 | A1 | 6/2005 |
| EP | 1 978 419 | A1 | 10/2008 |
| FR | 1 491 183 | | 9/1966 |
| JP | 48-035856 | | 5/1973 |
| JP | 58-128556 | | 8/1983 |
| JP | 59-160791 | | 9/1984 |

OTHER PUBLICATIONS

Office Action dated Mar. 18, 2009 in related co-pending U.S. Appl. No. 12/062,919, filed Apr. 4, 2008.

Patent Abstracts of Japan corresponding to JP 58-128556 of Aug. 1, 1983, which is filed herewith as "Exhibit A".

Illustrated Professional Dictionary of Horology I+II 817 (2002), which is filed herewith as "Exhibit B".

Delphion Integrated View corresponding to EP 1538494A1, downloaded on Jun. 23, 2010 from https://www.delphion.com/details?pn=EP01538494A1, which is filed herewith as "Exhibit C".

Notice of Allowance issued in co-pending related U.S. Appl. No. 12/062,919, dated Jun. 29, 2010.

* cited by examiner

CORRECTION DEVICE FOR TIMEPIECE DISPLAY MECHANISM AND WHEEL FITTED THERETO

This application claims priority from European Patent Application No. 07105669.1, filed Apr. 4, 2007, the entire disclosure of which is incorporated herein by reference.

FIELD OF THE INVENTION

The present invention relates to the field of horology. It concerns more specifically a correction device for a time indication display mechanism including a wheel fitted with two toothings located in the same plane. The invention also concerns the wheel itself.

BACKGROUND OF THE INVENTION

Mechanisms displaying a time indication, such as the date, are known to those skilled in the art. They typically include a display member, such as a date ring, a mechanism driving the display member, and a correction device activated by a winding stem. Correction devices are generally complex and cumbersome. They typically include at least one intermediate wheel activated by a pinion mounted on the winding stem, and a sliding or stationary corrector pinion, meshed with the intermediate wheel and with the display member.

A major drawback of this type of correction device is its thickness, mainly due to the intermediate wheel, which includes two toothing levels. By way of example, JP Patent No 59 160791 may be cited, wherein the intermediate wheel includes a first toothing level meshed with the pinion of the winding stem, and a second toothing level meshed with a second intermediate wheel. In JP Patent No 48 35856, the intermediate wheel is arranged as an overthickness of the winding stem pinion. It includes a contrate toothing meshed with the pinion, and a radial toothing meshed with the corrector pinion. Further, the corrector pinion also includes two active levels. Because of their thickness, these devices are not suited to ultra-thin movements.

Other correction devices, of much simpler design, include a pinion mounted on the winding stem, directly meshed with a toothing of the display member. The pinion therefore includes two substantially helical wings, arranged for cooperating in one direction of rotation only, with the toothing of the display member. The display member is generally positioned using a jumper spring. This type of correction device is certainly extremely simple, but it is cumbersome for display members of large diameter Indeed, the diameter of the pinion must be in ratio to the pitch of the display member toothing, so that each wing drives the display member through one step when the pinion rotates. The diameter of the pinion is, consequently, all the more important the larger the diameter of the display member, which is why this device is ill suited to ultra-thin movements.

SUMMARY OF THE INVENTION

The present invention proposes overcoming these drawbacks by providing a simple correction device with a minimum space requirement, mainly as regards thickness.

More specifically, the invention concerns a correction device for a timepiece display mechanism of the type including a display member fitted with a toothing of pitch P, the correction device including a pinion fitted with a toothing of pitch p, mounted on a winding stem so as to occupy at least one correction position, and an intermediate wheel mounted between the pinion and the display member. According to the invention, the intermediate wheel includes a main toothing of pitch P, of head diameter D, of foot diameter d1 meshed with the toothing of pitch P of the display member, and a secondary toothing of pitch p less than P, concentric to the main toothing, located in the same plane as the main toothing, of head diameter D equal to the head diameter d1 of the main toothing, and of foot diameter d2 greater than the foot diameter of the main toothing, meshed with the toothing of pitch p of the pinion when the pinion occupies the correction position.

Owing to the features of the intermediate wheel, the thickness of the correction device according to the invention does not exceed the diameter of the pinion. Moreover, as the pinion is not directly meshed with the display member as is the case of the pinion with wings that was described above, but with the second toothing of pitch p, the diameter and space requirement thereof are reduced.

The invention also concerns a timepiece wheel fitted to this correction device.

More specifically, the invention concerns a substantially plane timepiece wheel including a first toothing defined by a pitch P, a head diameter D and a foot diameter d1, including at least one tooth provided with a tip that extends substantially angularly. According to the invention, the tip portion of the first teeth is cut so as to form a second coplanar toothing concentric to the first toothing, the second toothing being discontinuous, defined by a pitch p less than pitch P of the first toothing, a head diameter D equal to the head diameter of the first toothing, and a foot diameter d2 greater than the foot diameter d1 of the first toothing.

BRIEF DESCRIPTION OF THE DRAWINGS

Other features and advantages of the present invention will appear more clearly upon reading the following detailed description of an example embodiment of the display mechanism correction device according to the invention, the example being given solely by way of non limiting illustration, with reference to the annexed drawings, in which.

DETAILED DESCRIPTION OF THE ILLUSTRATIVE EMBODIMENTS

Figure 1:
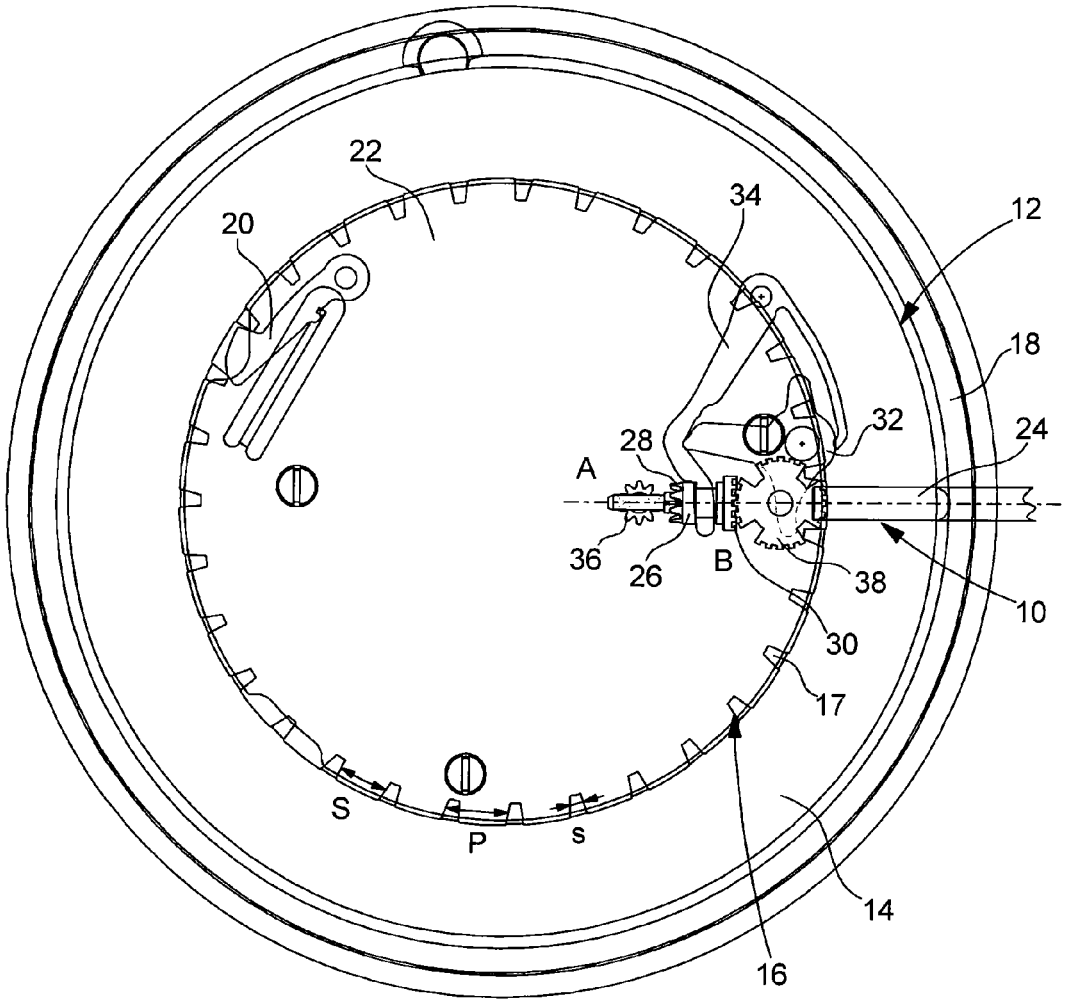
FIGS. 1 and 2 are respectively top and cross-sectional views of a display mechanism correction device according to the invention.
Figure 2:
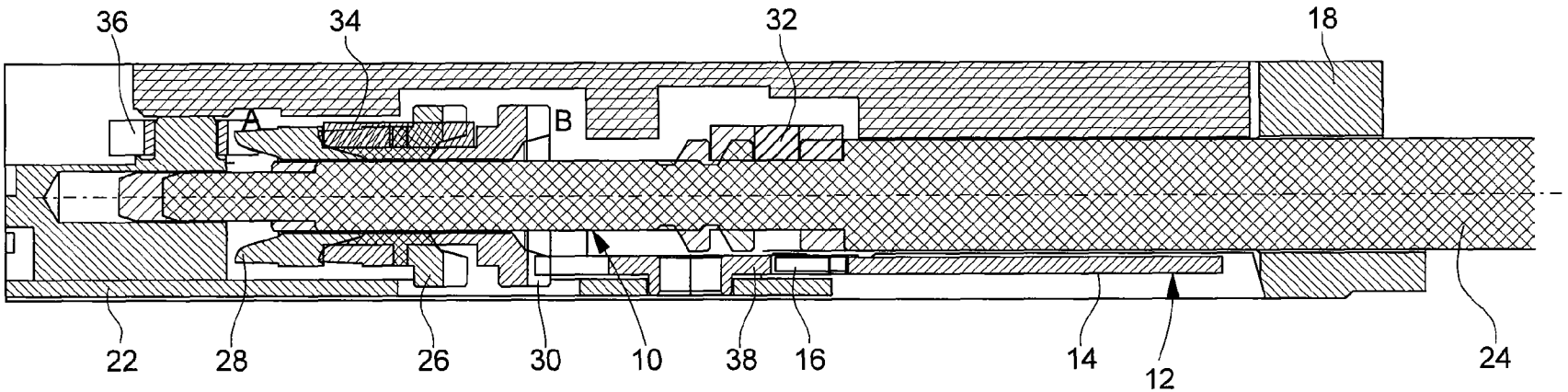

Designated by the general reference number 10, the correction device shown in FIGS. 1 and 2 is for correcting the display of a time indication provided by a display member 12. The time indication is, for example, a date, a month or a day of the week. Display member 12 is conventionally formed of a ring 14, on which time indication markings are marked. It is provided with an inner toothing 16 of pitch P, formed of teeth 17 of width s, separated by a space of width S=P−s. Display member 12 is also mounted so as to be guided in rotation on a plate 18, and angularly positioned via a jumper spring 20. A holding plate 22 partially covering toothing 16 and secured to plate 18, positions display member 12 axially. A drive mechanism for display member 12 is provided but not shown. It includes, for example, in the case of a date display, a date drive wheel activating display member 12 by one step per day, driven by an intermediate hour wheel. This mechanism is conventional and will not be described further.

Correction device 10 includes, in a conventional manner, a winding stem 24 mounted to move in rotation in plate 18 and provided, at the external end thereof, with a winding crown that is not shown. Winding stem 24 is slidably mounted so as to occupy a neutral position, in which it is pushed in as far as possible, and two active positions, which are first and second pulled out positions. A sliding pinion 26 is secured in rotation to winding stem 24. Winding stem therefore has a square section on one portion occupied by sliding pinion 26. Sliding pinion 26 has a hole that is adapted in shape and size to the section of winding stem 24. It further includes at a first end thereof a first straight contrate toothing 28, and at a second end, a second contrate toothing 30 of pitch p. The second contrate toothing 30 is straight, but other toothing shapes could be envisaged, as will appear below.

Sliding pinion 26 is activated conventionally by a mechanism formed of a pull out piece 32 and a lever 34 cooperating with each other to pass the pinion from a neutral position, when winding stem 24 is in a neutral position, to a time indication correcting position A, when winding stem 24 occupies a first pulled out position, then to a time setting position B, when winding stem 24 occupies the second pulled out position. This mechanism activating sliding pinion 26 is well known to those skilled in the art and will not be described further.

In the time setting position B, sliding pinion 26 meshes, via the first toothing 28 thereof, with intermediate wheel 36, kinematically connected to a cannon pinion that is not shown. The time can be set by activating winding stem 24, in either direction of rotation.

Figure 3:
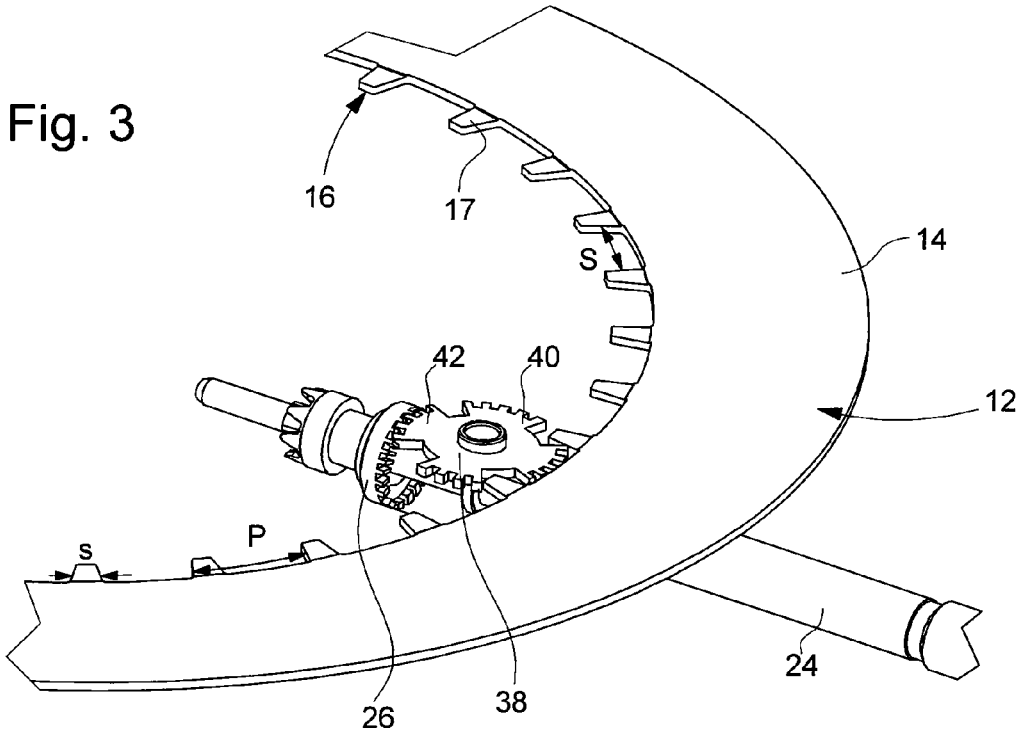
FIG. 3 is a perspective view of one part of the correction device according to the invention.
Figure 4:
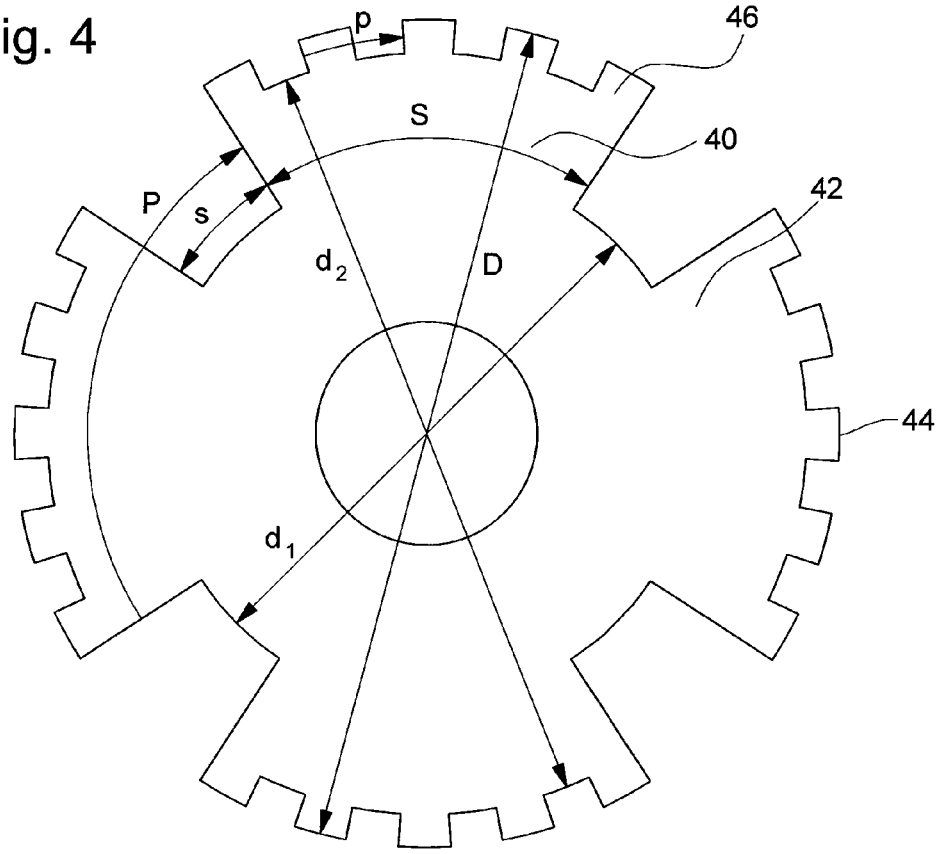
FIG. 4 shows a timepiece wheel fitted to this device.

In the time indication correcting position A, sliding pinion 26 meshes, via the second toothing 30 thereof, with a correction wheel 38 mounted to rotate freely on holding plate 22. Correction wheel 38 is itself meshed with toothing 16 of display member 12. The assembly formed by winding stem 24, sliding pinion 26, correction wheel 38 and display member 12 is shown in FIG. 3, in the time indication correcting position A. The features of correction wheel 38 appear in more detail in FIG. 4.

Correction wheel 38 includes a first toothing 40 of pitch P, of head diameter D, and foot diameter d1. Toothing 40 meshes with toothing 16 of display member 12. Thus toothing 40 is completely complementary to toothing 16. It is formed of teeth 42, of width S, equal to the width of the space between two consecutive teeth 17, separated by a space of width s=P−S, equal to the width of teeth 17.

Teeth 42 further include two substantially radial flanks and a tip 44 that extends substantially angularly. Tip 44 is cut so as to form a second toothing 46, which is discontinuous, coplanar and concentric to first toothing 40, of pitch p less than pitch P of the first toothing, of head diameter D equal to the head diameter of first toothing 40 and of foot diameter d2 greater than the foot diameter d1 of first toothing 40. Toothing 46 meshes with the contrate toothing 30 of sliding pinion 26.

It will be noted that toothing 46 has large discontinuities, because it is only present at tip 44 of teeth 42 of the first toothing 40. However, in order for correction device 10 to operate properly, the second toothing 46 must be meshed, at least via one tooth, with contrate toothing 30 of sliding pinion 26. Therefore, the spaces of width s separating two consecutive teeth 42 are as small as possible. In practice, they cannot be less than the width s of teeth 17 forming toothing 16 of display member 12. Consequently, one must ensure that the width s of teeth 17 of display member 12 is as small as possible.

When winding stem 24 is activated, as sliding pinion 26 is in position A, the latter drives correction wheel 38 in rotation, which itself drives display member 12, in one direction of rotation or the other. The time indication is thus corrected.

Figure 5:
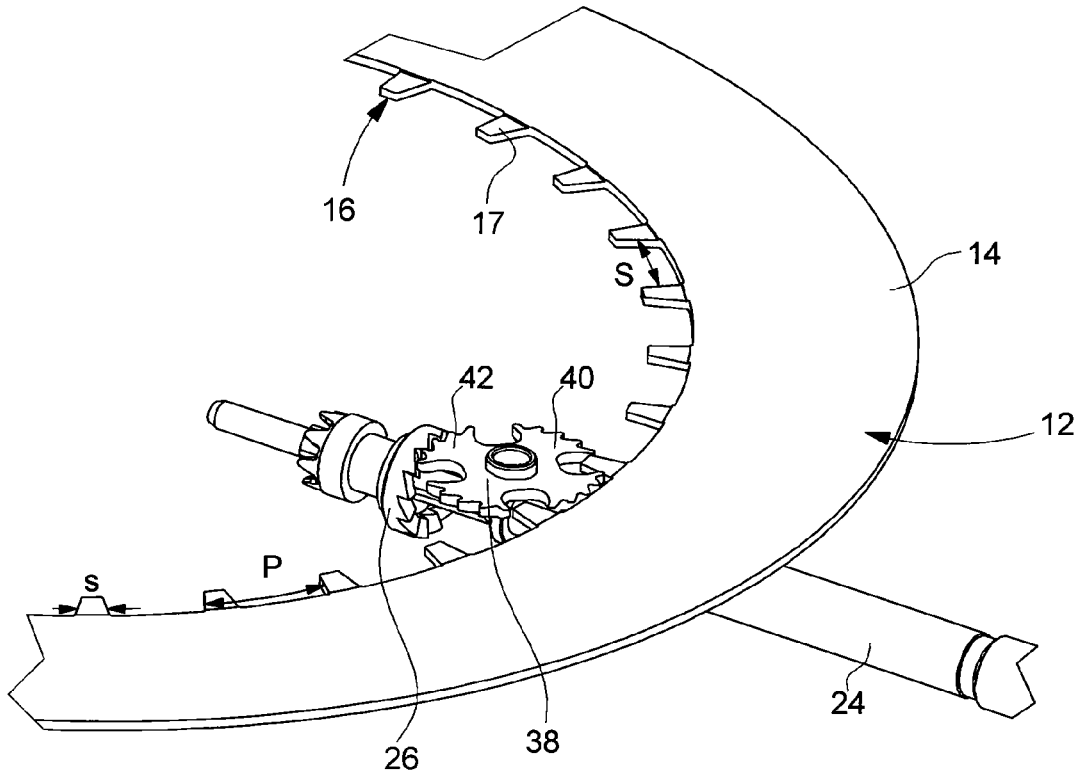
FIG. 5 illustrates a variant of the correction device according to the invention.

In the embodiment presented above, contrate toothing 30 and second toothing 46 are straight, which allows coupling in both directions of rotation. In a particular embodiment illustrated in FIG. 5, contrate toothing 30 and second toothing 46 are saw like toothings, such that the two toothings cooperate in a single direction of rotation, like two Breguet toothings. Sliding pinion 26 and correction wheel 38 then form a single directional coupling for correcting the display member in a single direction of rotation. For more details as to the operating mode of this type of coupling, reference can be made to the EP Application No. 07105670.9 filed on 4 Apr. 2007, in the name of ETA S.A., and entitled "Accouplement à sens unique et dispositif de correction comportant un tel accouplement".

Correction device 10 thus described is extremely simple and compact. It is perfectly suited to an ultra-flat movement of the mechanical or electromechanical type.

It goes without saying that the present invention is not limited to the embodiments that have just been described and that various simple alterations and variants could be envisaged by those skilled in the art without departing from the scope of the present invention as defined by the annexed claims. It will be noted in particular that a correction wheel 38 that comprises only one tooth 42, wherein one tip portion 44 extends angularly and is cut so as to form a second toothing 46, coplanar and concentric to the first, is within scope of the invention.

What is claimed is:

1. A plane timepiece wheel including:

a first toothing defined by a first pitch P, a first head diameter D, a first foot diameter d1, and including a plurality of first teeth, wherein each first tooth of the plurality of first teeth is provided with a tip, wherein at least one portion of the tip extends angularly, wherein the at least one portion of the tip is cut so as to form a second toothing that includes a plurality of second teeth that is coplanar and concentric to the first toothing, wherein the second toothing is defined by a second pitch p that is less than the first pitch P of the first toothing, a second head diameter D that is equal to the first head diameter D of the first toothing, and a second foot diameter d2 that is greater than the first foot diameter d1 of the first toothing, wherein the first toothing is adapted to engage a first member of a timepiece display mechanism and the second toothing is adapted to engage a second member of a correction device, wherein the correction device is operably connected to the timepiece display mechanism.

2. The timepiece wheel according to claim 1, wherein said first toothing is formed of first teeth, wherein each first tooth is provided with a tip, and each tip extends substantially angularly, and wherein said tip is cut so as to form the second toothing as a discontinuous toothing that is coplanar and concentric to said first toothing, wherein the second toothing is defined by the pitch p less than the pitch P of the first toothing, the head diameter D equal to the head diameter D of the first toothing, and the foot diameter d2 that is greater than the foot diameter d1 of the first toothing.

3. The timepiece wheel according to claim 2, wherein said second toothing is a saw-shaped toothing.

4. The timepiece wheel according to claim 2, wherein said second toothing is straight.

5. The timepiece wheel according to claim 2, wherein said first teeth have a width S, separated by a space of width s, wherein said width S of the first teeth is large relative to the width s of the space separating two first teeth.

6. The timepiece wheel according to claim 1, wherein the first pitch P is a multiple of the second pitch p.

7. The timepiece wheel according to claim 6, wherein said first teeth have a width S, separated by a space of width s, wherein said width S of the first teeth is large relative to the width s of the space separating two first teeth.

8. The timepiece wheel according to claim 1, wherein said second toothing is a saw-shaped toothing.

9. The timepiece wheel according to claim 8, wherein said first teeth have a width S, separated by a space of width s, wherein said width S of the first teeth is large relative to the width s of the space separating two first teeth.

10. The timepiece wheel according to claim 1, wherein said second toothing is straight.

11. The timepiece wheel according to claim 1, wherein said first teeth have a width S, separated by a space of width s, wherein said width S of the first teeth is large relative to the width s of the space separating two first teeth.

12. The timepiece wheel according to claim 1, wherein the first member of the timepiece display mechanism is a display member comprising a ring and a third toothing connected to the ring, and the first toothing is adapted to engage the third toothing of the display member, and wherein the second member of the correction device is a sliding pinion comprising a fourth toothing, wherein the second toothing is adapted to engage the fourth toothing of the sliding pinion.

13. The correction device according to claim 12, wherein the third toothing of the display member comprises a plurality of third teeth and the fourth toothing of the correction device comprises a plurality of fourth teeth, and each fourth tooth of the fourth toothing of the correction wheel has a width S that is equal to the width of a space between two consecutive third teeth of the third toothing.

14. A correction device operably connected to a timepiece display mechanism, wherein the timepiece display mechanism includes a display member fitted with a first toothing of first pitch P, wherein the correction device includes:

(a) a pinion provided with a second toothing of second pitch p, mounted on a winding stem so as to occupy at least one display correcting position A; and (b) a correction wheel mounted between the pinion and the display member, wherein the correction wheel includes i. a third toothing defined by the first pitch P, a first head diameter D, and a first foot diameter d1, wherein the third toothing is formed of a plurality of first teeth, wherein each first tooth includes a tip extending angularly, and wherein the tip is cut so as to form a fourth toothing that includes a plurality of second teeth, wherein the fourth toothing is coplanar and concentric to the third toothing, and the fourth toothing is defined by the second pitch p that is less than the first pitch P of the third toothing, a second head diameter D equal to the first head diameter D of the third toothing, and a second foot diameter d2 greater than the first foot diameter d1 of the third toothing, wherein the third toothing of the correction wheel is arranged to engage the first toothing of the display member.

15. The correction device according to claim 14, wherein said pinion is slidably mounted between a time-setting position B and said display correcting position A.

16. The correction device according to claim 15, wherein the correction device further includes means for tipping said pinion from said time-setting position B to said display correcting position A, and vice versa.

17. The correction device according to claim 15, wherein said first toothing of said pinion and said fourth toothing of said correction wheel are saw shape toothings.

18. The correction device according to claim 14, wherein said first toothing of said pinion and said fourth toothing of said correction wheel are saw shape toothings.

19. The correction device according to claim 14, wherein the fourth toothing of the correction wheel is arranged to engage the second toothing of the pinion.

20. The correction device according to claim 14, wherein the first toothing of the display member comprises a plurality of third teeth, and each first tooth of the third toothing of the correction wheel has a width S that is equal to the width of a space between two consecutive third teeth of the first toothing.

* * * * *